US005664298A

United States Patent [19]

Nessar-Ivanovic

[11] Patent Number: 5,664,298

[45] Date of Patent: Sep. 9, 1997

[54] JEWELRY CLASP

[76] Inventor: Lori J. Nessar-Ivanovic, 124 Leslie Ln., Havelock, N.C. 28532

[21] Appl. No.: 640,240

[22] Filed: Apr. 30, 1996

[51] Int. Cl.[6] ..... A44B 11/00

[52] U.S. Cl. ..... 24/303; 292/251.5; 335/285; 248/206.5

[58] Field of Search ..... 24/303, 66.1; 248/206.5; 292/251.5; 335/285

[56] References Cited

U.S. PATENT DOCUMENTS

| | | | |
|---|---|---|---|
| 2,615,227 | 10/1952 | Hornik | 24/303 |
| 2,648,884 | 8/1953 | Loofboro | 24/303 |
| 2,654,929 | 10/1953 | Feibelman | 24/303 |
| 2,959,832 | 11/1960 | Baermann | 24/303 |
| 3,027,617 | 4/1962 | Gray | 24/303 |
| 3,293,714 | 12/1966 | Shafer | 24/303 |
| 4,231,137 | 11/1980 | Fujimoto . | |
| 4,399,595 | 8/1983 | Yoon et al. | 24/303 |
| 4,458,395 | 7/1984 | Aoki . | |
| 4,853,048 | 8/1989 | Shimizu et al. . | |
| 5,099,659 | 3/1992 | Carranza et al. . | |
| 5,197,168 | 3/1993 | Levy . | |
| 5,323,516 | 6/1994 | Hartmann | 24/303 |
| 5,349,725 | 9/1994 | Levy . | |
| 5,367,891 | 11/1994 | Furuyama | 24/303 X |
| 5,432,986 | 7/1995 | Sexton | 24/303 |

FOREIGN PATENT DOCUMENTS

| | | | |
|---|---|---|---|
| 190993 | 8/1964 | Sweden | 24/303 |

*Primary Examiner*—Peter M. Cuomo
*Assistant Examiner*—Hanh V. Tran
*Attorney, Agent, or Firm*—Tarolli, Sundheim, Covell Tummino & Szabo

[57] ABSTRACT

A clasp for a piece of jewelry comprises a first part and a second part. Each of the parts comprises a trailing end, a leading end, a connection on the leading end, and a center line intersecting the leading and trailing ends. The first part comprises a receiving surface and at least one magnet in the receiving surface providing north and south poles on opposite sides of the first part center line. The second part comprises a matching surface which conforms to the first part receiving surface when the first and second parts are engaged and at least one magnet in the matching surface providing south and north poles on opposite sides of the second part center line. When the first and second parts are engaged, the magnets are aligned and in an attracting relationship. The first and second parts have a tongue and socket connection which acts along the first and second parts center lines and resists separation of the parts in a longitudinal direction by forces acting in the direction of the parts leading ends.

6 Claims, 1 Drawing Sheet

JEWELRY CLASP

BACKGROUND OF THE INVENTION

The present invention relates to jewelry, and primarily to a magnetic clasp for jewelry.

Many pieces of jewelry are provided with a clasp for holding two ends of the jewelry piece together. Often, when donning the jewelry piece it is necessary to hold the two ends of the jewelry piece with one hand while manipulating and closing the clasp with the other hand. This can require considerable dexterity, and can be difficult for some people.

It is known to provide a clasp in which magnets assist in the closure step.

U.S. Pat. No. 5,197,168 discloses a jewelry closure which comprises first and second members held together magnetically. A mechanical safety closure is mounted pivotally on one of the members and engages, by pivotal movement, a surface of the other member. The mechanical safety closure can be characterized as a bale-type closure in the sense that it wraps around the other member. Such a closure can become accidentally dislodged from its safety catch position, for instance by engaging on a piece of clothing.

U.S. Pat. No. 5,349,725 also discloses a jewelry closure in which first and second members are magnetically held together. The closure also comprises a resilient mechanical plate on one member which engages a shaped detent in the other member. The first and second members are the end pieces of first and second halves of a ring which are pivotally connected and bring the plate and shaped detent into engagement with each other, without manipulation, when the ring is closed.

U.S. Pat. No. 4,231,137 also discloses a jewelry clasp in which first and second members are magnetically held together. One member has a projection and the other member a groove. The projection and groove are engaged when the two members are brought together. The magnets are mounted in opposed polarity so that they attract only when the members are in correct orientation and repel when the members are incorrectly oriented.

U.S. Pat. No. 4,458,395 discloses a first part having a permanent magnet, and a second part having a plug of ferro magnetic material attracted to the magnet of the first part. A cover of non-magnetic material directs the magnetic force so that the second part is attracted to the first part when the second part is properly aligned with the first part.

U.S. Pat. No. 5,099,659 discloses first and second parts which have attracting magnets. One part comprises a south pole magnet and the other a north pole magnet to provide a strong attraction. The parts have cooperating, facing indentations and protrusions which hinder lateral separation of the parts, and at the same time provide a slight gap between the parts to facilitate separation.

SUMMARY OF THE INVENTION

The present invention relates to a clasp for a piece of jewelry. The clasp comprises a first part and a second part. Each of said parts comprises a trailing end, a leading end, a connection on said leading end, and a center line intersecting said ends. Said first part comprises a receiving surface, and at least one magnet in said receiving surface providing north and south poles on opposite sides of said first part center line. Said second part comprises a matching surface which conforms to said first part receiving surface when said first and second parts are engaged. The second part comprises at least one magnet in said matching surface providing south and north poles on opposite sides of said second part center line. When the first and second parts are engaged, said magnets of the two parts are aligned and in an attracting relationship, the first and second parts center lines are in the same plane, and said leading ends are oriented in opposite directions. Locking means are provided between the first and second parts acting along the first and second parts center lines resisting separation of the parts.

Preferably, the locking means comprises a socket in said first part receiving surface aligned with said first part center line and a tongue in said second part matching surface aligned with said second part center line wherein said socket and tongue resist separation of said parts by forces acting in the direction of said parts leading ends.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF PREFERRED EMBODIMENTS

Figure 1:
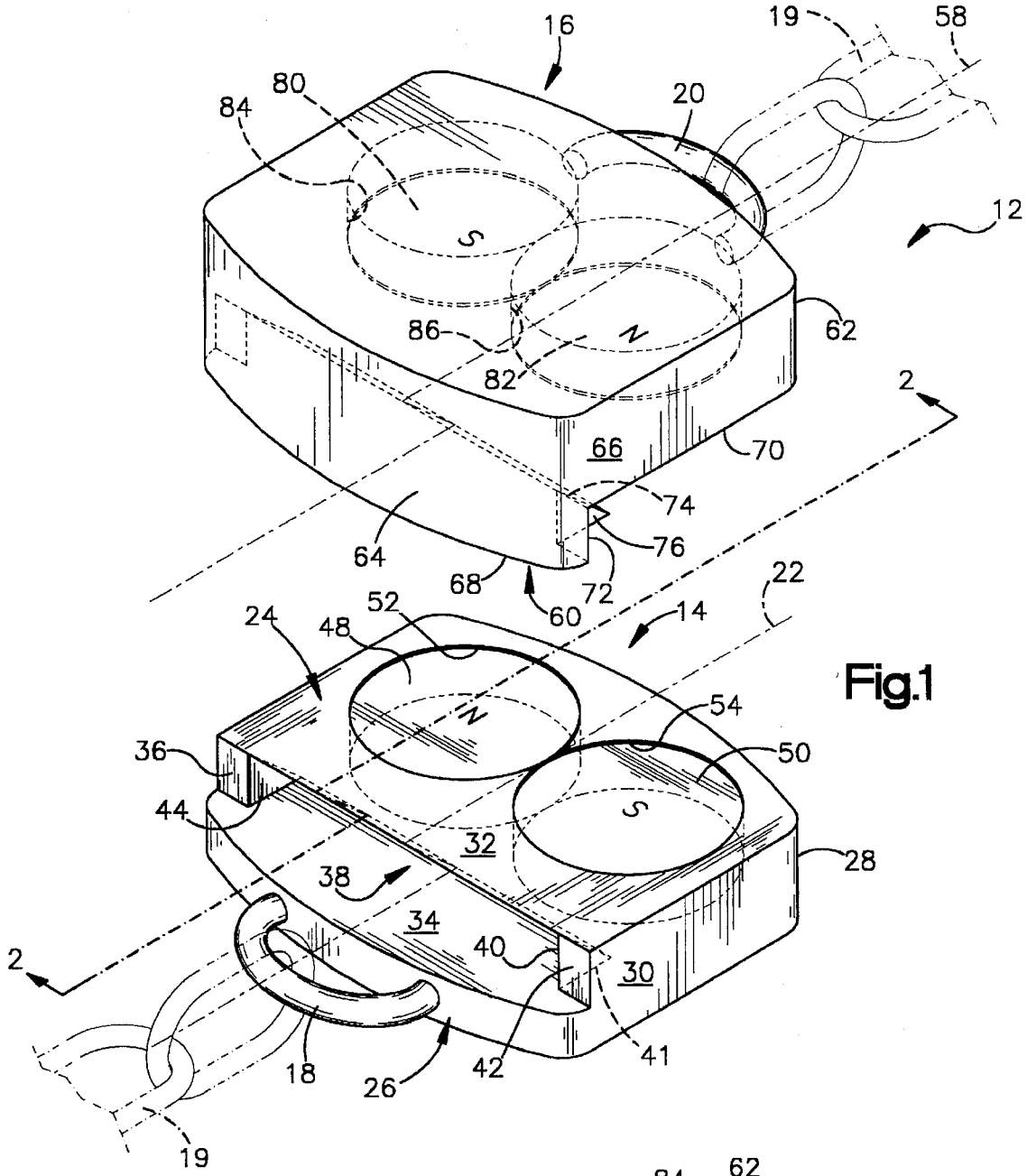
FIG. 1 is an enlarged perspective view of a clasp for a piece of jewelry in accordance with the present invention.

Referring to the Figures, a jewelry clasp 12 is disclosed. The clasp 12 comprises a first part 14 and a second part 16. The first part 14 has a connection 18 which connects to one end of a jewelry component 19. The second part 16 has a connection 20 which connects to an opposite end of the jewelry component 19.

The first part 14 is generally rectangular in configuration and comprises a longitudinal center line 22. The first part 14 also comprises a top face 24 which is generally planar, end faces 26 and 28, and opposed sides of which only one side 30 is visible. Connection 18 protrudes from end face 26. End face 26 is a leading end face in the sense that it faces in the direction in which it is pulled by jewelry component 19 attached to connection 18. End face 28 can thus be characterized as a trailing end face.

The top face 24 comprises a raised surface 32 which is adjacent trailing end 28, and a recessed surface 34 which is adjacent leading end 26. A transition surface 36 extends between the raised surface 32 and the recessed surface 34. The transition surface 36 is in a plane which is generally at right angles to the first part center line 22. The transition surface 36 comprises a socket 38 which comprises an open end 40 facing the first part leading end 26.

The socket 38 has a generally triangular cross section, as shown by dashed line 41, and is defined on its sides by thin webs 42 and 44.

The first part 14 also comprises a pair of magnets 48 and 50 which are embedded in the raised surface 32 of the top face 24. The magnets 48 and 50 are adjacent the trailing end 28 of the first part 14, and are arranged to provide a north pole on one side of center line 22 and a south pole on the opposite side of the center line 22. The magnets 48 and 50 are cemented or otherwise affixed into holes 52 and 54 in the first part raised surface 32 and are substantially flush with the surface 32.

The second part 16 also has a generally rectangular configuration, which is generally complementary to the configuration of the first part 14. The second part 16 comprises a center line 58. The second part 16 also comprises a planar bottom face 60, a leading end 62 to which connection 20 is attached, and an end 64 which is opposite end 62 of part 16. The part 16 also comprises side faces of which only one side face 66 is visible. As with part 14, the end face 62 is a leading end in the sense that it is facing in the direction in which it is pulled by jewelry component 19 attached to connection 20. End face 64 can thus be characterized as a trailing end face.

The bottom face 60 is generally planar in a transverse direction and comprises a raised surface 68 which is adjacent trailing end 64 and a recessed surface 70 which is adjacent leading end 62. A transition surface 72 extends between the raised surface 68 and the recessed surface 70. The transition surface 72 is in a plane which is generally at right angles to the second part center line 58. The transition surface 72 comprises a tongue 74 which extends in a direction towards leading end 62. The tongue 74 has a generally triangular configuration when viewed from the side 66 of part 16, and is defined on its sides by triangular surfaces of which only surface 76 is visible. As shown in FIG. 1, side 76 is slightly undercut, as is the opposite side of tongue 74, with respect to the sides (e.g., 66) of the part 16 to accommodate webs 42 and 44 of part 14.

Figure 2:
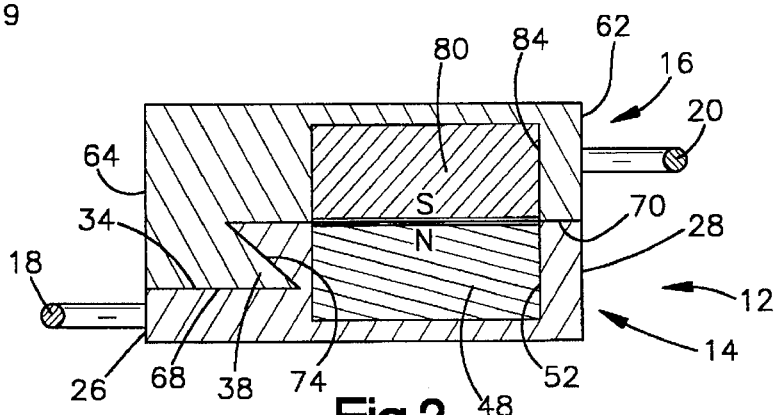
FIG. 2 is a section view taken along line 2—2 of FIG. 1.

When the two parts 14 and 16 of the clasp 12 are brought together, as shown in FIG. 2, the tongue 74 of the second part 16 seats within the socket 38 of the first part 14, providing a locking means which prevents the first and second parts 14 and 16 from being pulled apart when pulled at their leading ends 26 and 62 by connections 18 and 20, respectively. When so brought together, the tongue 74 of the second part 16 fits snugly within the socket 38 of the first part 14.

In addition to resisting longitudinal separation of the first and second parts 14 and 16, the locking means comprising the tongue 74 and the socket 38 resists lateral or rotational movement of one part with respect to the other, such movement being hindered in part by webs 42 and 44 of the socket 38.

The second part 16 also comprises a pair of magnets 80 and 82 which are embedded in the recessed surface 70 of the second part 16. The magnets 80 and 82 are preferably adjacent leading end 62 of the second part 16 and are cemented or otherwise affixed in holes 84 and 86 in the recessed surface 70. As with part 14, the magnets 80 and 82 are generally flush with the surface 70 of the part 16, and are on opposite sides of the center line 58 of the part 16, providing a north pole on one side of the center line 58 and a south pole on the opposite side of the center line 58. However, the magnets 80 and 82 are arranged in the part 16, so that when the parts 14 and 16 are brought together, they are in an attracting relationship with respect to the magnets 48 and 50 of the first part 14, rather than in a repelling relationship. The north pole of part 16 is aligned with and faces a south pole of part 14, and the south pole of part 16 is aligned with and faces a north pole of part 14.

When it is desired to couple the first and second parts 14 and 16 together, it is a simple matter to bring the two parts 14 and 16 close to one another. When brought close to one another, the attractions of magnets 48, 50, 80 and 82 are sufficient to snap one part into seating engagement with the other. By seating engagement it is meant into proper alignment in which: (1) tongue 74 of part 16 seats within socket 38 of part 14; (2) raised surface 32 of part 14 seats against recessed surface 70 of part 16; (3) the center lines 22 and 58 of parts 14 and 16 are in the same plane; and (4) magnets 80 and 82 of part 16 are aligned with the magnets 48 and 50 of part 14. In addition, the opposite sides of the parts 14 and 16, for instance sides 30 and 66, as well as ends 26, 28 and 62, 64 are all flush presenting a pleasing appearance.

The location of the magnets 48, 50, 80 and 82 prevent any alignment of the parts 14 and 16 other than the above-mentioned proper alignment. By using a pair of magnets in each part, on opposite sides of the center lines 58 and 22, this prevents one part 16 from engaging the other part from an angle, or askew with respect to the other part, thus facilitating coupling of the parts and introduction of the tongue 74 of part 16 into the socket 38 of part 14. In this respect, the pairs of magnets 48, 50, 80 and 82, on opposite sides of the parts center lines 22 and 58, provide a torquing action as well as longitudinal and lateral attraction forces which help align the tongue 74 of part 16 with the socket 38 of part 14 and permit seating the parts snugly one against the other. The pairs of magnets 48, 50, 80 and 82 also resist separation of the parts 14 and 16 when one part is subjected to a torquing action with respect to the other, as well as resisting longitudinal separation.

It will be apparent to those skilled in the art that the locking mechanism of the present invention can have other configurations than the tongue 74 of part 16 and the socket 38 of part 14. For instance, the tongue 74 and the socket 38 can extend the full width of the parts 14 and 16. The side webs 42 and 44 of the socket 38 are preferred to resist dislodgment of one part from the other from an accidental lateral or torquing force applied to one of the parts. Also, although the tongue and socket arrangement as shown is preferred with respect to preventing longitudinal separation of the parts 14 and 16 by forces pulling in the parts leading directions, it is possible to use a mechanical connection between the parts, for instance a pivotable latch on one part engaging a catch on the other part. Such a mechanical connection can be used with or in place of the tongue and socket arrangement shown in the Figures. With such a mechanical connection, the principals of the present invention apply. The pivotable latch would preferably pivot in a plane aligned with the parts center lines 22 and 58. The torquing action of the pairs of magnets 48, 50, 80 and 82, on opposite sides of the parts center lines 22 and 58, would bring one part into alignment with the other part so that engagement of a latch on one part with a catch on the other part would be facilitated.

However, it has been found that the clasp of the present invention is secure without a mechanical coupling.

To separate the parts 14 and 16, it is a simple matter to slide one part longitudinally in a trailing direction with respect to the other part. This is done by engaging one part with one finger and the other part with another finger and exerting trailing direction forces on both parts. The frictional force between the parts and the fingers is all that is necessary. Once a small separation of the parts is achieved, in a longitudinal direction, the attracting force of the magnets 48, 50, 80 and 82 is weakened and complete separation of the parts 14 and 16 can then be accomplished by sliding the parts sideways with respect to each other.

The magnets 48, 50, 80 and 82 in the present invention are preferably rare earth magnets. Good results have been obtained using magnets comprising a rare earth alloy of neodymium, iron and boron, marketed by SGM Armtech, Inc., of New Town, Penn.

Preferably, the first and second parts are made by molding or casting. Instead of using pairs of magnets in each part, such as magnets 48 and 50 of part 14, or magnets 80 and 82 of part 16, it is possible to use pin or bar magnets having north and south poles at opposite ends, wherein the pin or bar magnets extend in a transverse direction laterally across the center lines 22 and 58 of the parts 14 and 16.

In the embodiment of the Figures, the magnets are very small, about 1/32nd or 1/16th of an inch in diameter and about 1/8th or 3/8ths inch in height. Preferably, the first an second parts are made by molding or casting.

From the above description of the invention, those skilled in the art will perceive other improvements, changes and modifications. Such improvements, changes and modifications within the skill of the art are intended to be covered by the appended claims.

Having described the invention, the following is claimed:

1. A clasp for a piece of jewelry comprising:

(a) a first part and a second part, each of said parts comprising a trailing end, a leading end, a connection on said leading end, and a center line intersecting said ends;

(b) said first part comprising a receiving surface between said first part leading and trailing ends and at least one rare earth magnet embedded in said receiving surface providing north and south poles on opposite sides of said first part center line;

(c) said second part comprising a matching surface between said second part leading and trailing ends conforming to said first part receiving surface when the first part and the second part are engaged and at least one rare earth magnet embedded in said matching surface providing south and north poles on opposite sides of said second part center line; wherein when said first and second parts are engaged, said magnets are aligned in an attracting relationship, said first and second part center lines are in the same plane, and said leading ends are oriented in opposite directions; and (d) locking means between said first and second parts acting along said first and second parts center lines resisting separation of the parts.

2. The clasp of claim 1 wherein said first part receiving surface comprises a socket aligned with said first part center line and said socket comprises an open end which faces said first part leading end, and said second part matching surface comprises a tongue aligned with said second part center line and said tongue projects in the direction of said second part leading end.

3. The clasp of claim 2 wherein said at least one magnet in each part comprises a first magnet on one side of the part center line providing a north pole and a second magnet on the opposite side of the part center line providing a south pole.

4. The clasp of claim 3 wherein said parts are mold-formed.

5. The clasp of claim 3 wherein said first part socket comprises sides resisting movement of the second part tongue in lateral directions with respect to the first part.

6. The clasp of claim 1 wherein said magnets are positioned so that a small longitudinal movement of one of said parts with respect to the other followed by a small lateral movement of said one part with respect to the other results in a repelling relationship of said magnets.

* * * * *